US005470431A

United States Patent [19]

Okuda et al.

[11] Patent Number: 5,470,431

[45] Date of Patent: Nov. 28, 1995

[54] STACK TYPE EVAPORATOR

[75] Inventors: Nobuyuki Okuda; Masayoshi Kojima, both of Oyamashi, Japan

[73] Assignee: Showa Aluminum Corp., Osaka, Japan

[21] Appl. No.: 123,856

[22] Filed: Sep. 17, 1993

Related U.S. Application Data

[63] Continuation-in-part of Ser. No. 901,077, Jun. 19, 1992, abandoned, which is a continuation-in-part of Ser. No. 759,644, Sep. 12, 1991, Pat. No. 5,152,337, which is a continuation of Ser. No. 569,569, Aug. 20, 1990, abandoned.

[30] Foreign Application Priority Data

Apr. 3, 1992 [JP] Japan ..... 4-082467
May 22, 1992 [JP] Japan ..... 4-131153

[51] Int. Cl.[6] ..... B01D 1/00; F28F 21/00

[52] U.S. Cl. ..... 159/28.6; 159/27.1; 159/DIG. 23; 159/DIG. 21; 165/133; 165/134.1; 165/153; 165/170; 165/913; 202/237; 202/267.1

[58] Field of Search ..... 159/28.6, DIG. 23, 159/27.1, DIG. 21; 165/153, 134.1, 170, 913, 133, 111, 152, 177; 106/197.1; 203/287.1, 10, 86; 202/237, 267.1

[56] References Cited

U.S. PATENT DOCUMENTS

| | | | |
|---|---|---|---|
| 3,664,888 | 5/1972 | Oga et al. | 159/DIG. 21 |
| 3,896,753 | 7/1975 | Shephard et al. | 106/197.1 |
| 4,011,905 | 3/1977 | Willard | 165/153 |
| 4,371,034 | 2/1983 | Yamada et al. . | |
| 4,712,612 | 12/1987 | Okamoto et al. | 165/145 |
| 4,723,601 | 2/1988 | Ohara et al. | 165/153 |
| 4,726,886 | 2/1988 | Kaneko et al. | 106/287.1 |
| 5,070,938 | 12/1991 | Mizuno et al. . | |
| 5,082,051 | 1/1992 | Ando | 165/153 |
| 5,125,456 | 6/1992 | Bertrand et al. | 165/153 |
| 5,152,337 | 10/1992 | Kawakatsu et al. | 165/153 |

FOREIGN PATENT DOCUMENTS

| | | |
|---|---|---|
| 409130 | 1/1991 | European Pat. Off. . |
| 271084 | 1/1991 | European Pat. Off. . |
| 415584 | 3/1991 | European Pat. Off. . |
| 3028304 | 2/1981 | Germany . |
| 3536325 | 5/1986 | Germany . |
| 387595 | of 0000 | Japan . |
| 56-6847 | 2/1981 | Japan . |
| 57-01862 | 1/1982 | Japan . |
| 6045776 | 10/1982 | Japan . |
| 61-39589 | 9/1986 | Japan . |
| 62-272099 | 11/1987 | Japan . |
| 63-33100 | 9/1988 | Japan . |
| 6461239 | 3/1989 | Japan . |
| 349944 | 7/1989 | Japan . |
| 1299877 | 12/1989 | Japan . |
| 2277584 | 11/1990 | Japan . |

OTHER PUBLICATIONS

Automotive Industries, vol. 146, No. 2, dated Jun. 15, 1972.

*Primary Examiner*—Virginia Manoharan
*Attorney, Agent, or Firm*—Tilton, Fallon, Lungmus & Chestnut

[57] ABSTRACT

A stack type evaporator includes tubular elements 1 each having a plurality of inwardly protruding recessed ribs 7 which extend from an upper header portion 1*a* of the element to a lower header portion 1*b*, with the ribs serving as straight drainage canals 7*a* of specified width and area. A hydrophilic resin coating of a specific composition covers the outer surfaces of the tubular elements 1 and fins 2 each interposed between two adjacent tubular elements. The combination of straight drainage canals, the specified width and area thereof and the specific hydrophilic resin coating is effective to facilitate the drainage of condensed water so that the waterdrop is substantially prevented from flying out of the evaporator, and the hydrophilic coating itself does not emit any unpleasant smell.

12 Claims, 14 Drawing Sheets

STACK TYPE EVAPORATOR

This application is a continuation-in-part of application Ser. No. 07/901,077 filed on Jun. 19, 1992, now abandoned, which was a continuation-in-part of application Ser. No. 07/759,644 filed Sep. 12, 1991, now U.S. Pat. No. 5,152,337 and which is a continuation of Ser. No. 569,569 filed Aug. 20, 1990, now abandoned.

BACKGROUND OF THE INVENTION

1. Field of the Invention

The present invention relates to an evaporator adapted for use in a car air conditioner, and more particularly relates to a stack type evaporator which is improved to first substantially limit the flying of the condensed waterdrops and second to substantially avoid bad odors.

2. Description of the Prior Art

The stack type evaporators of this kind usually comprise plate-like tubular elements each composed of a pair of dish-like core plates 60 as shown in FIG. 11. These core plates face one another and are joined at their peripheries 60*a*. Such tubular elements are stacked side by side in the direction of thickness, with fin members each being interposed between the adjacent tubular elements. Inlet and outlet header portions 60*b* and 60*c* are formed at an end of each tubular element to form a coolant flow path. A coolant flowing through the inlet header portion 60*b* into the flow path in the tubular element will travel towards another end thereof, and makes one U-turn before coming back into the outlet header portion 60*c*. These tubular elements thus constitute the "one-sided header" stack type evaporator which is employed widely in this field.

The 37 one-sided header" structure is somewhat disadvantageous in that due to the U-turn which the coolant makes, it cannot flow evenly through the tubular elements but flows in an uneven manner. This will inevitably reduce the effective heat transfer area of each tubular element.

Therefore, another type of evaporator which is of the "both-sided header" structure has been proposed and used in certain cases. This evaporator comprises the tubular elements each having the inlet header portion at its one end and the outlet header portion at its other end.

The prior art stack type evaporators, whether of the one-sided or both-sided structure, employ recessed ribs 70 which are distributed over each core plate 60 as shown in FIG. 11. Those ribs are intended to render turbulent the coolant stream within the tubular elements so as to improve the heat transfer. In detail, many recessed ribs 70 protrude inwardly of two dish-like core plates 60 which are secured one to another at their peripheries to constitute as before each tubular element ( see for example Japanese Utility Model Publication Sho. 56-6847 and ibid. 63-33100).

However, in the use of those stack type evaporators, water which is condensed on the surface of the tubular elements and fin members will stay within the obliquely arranged recessed ribs 70. An angle of contact (hereinafter simply referred to as "contact angle") of each waterdrop with the surface of tubular element or fin member, to which the waterdrop sticks, is so large as to make it difficult for the condensed water to drain smoothly. As a result, the condensed water stays within the air paths, which are each formed between the tubular elements, and through the fin members interposed therebetween, so as to be scattered to fly into the automobile interior compartment to spoil the air-conditioned comfort thereof. Further, the air paths get mildewed due to the adherent condensed water, and a bad smell of mildew or mold will render unpleasant the air stream which flows into the compartment.

In one expedient made to resolve such a problem, the tubular elements and fin members were covered with a hydrophilic surface coating. This coating reduced the contact angle between the surface of tubular element or fin member and the waterdrop. Consequently, the condensed water formed on the surfaces a thin layer which decreased the air flow resistance along the surface, and the thin layer did not stay thereon but was drained smoothly to resolve the problem of flying waterdrop.

A water glass-based coating, as described for example in Japanese Patent Publication Sho. 60-45776, has been preferred as the prior art hydrophilic coating of this kind. A bad smell (like the fishy smell emitted from a hardening cement) inherent in this water glass coating is unpleasant, and spoils the air-conditioned automobile interior into which the air stream flows. Thus, such a prior art coating is not free from the essential problem of bad smell.

A further proposal was made in Japanese Patent Laying-Open Gazette Sho. 62-272099 and also in the U.S. Pat. No. 4,726,886, in order to diminish the bad smell from the hydrophilic coating composed of water glass. The coating in accordance with the further proposal includes silanol, which is a hydrated silicon oxide, and polyvinyl pyrrolidone added thereto. However, because of the silicon oxide-based compound contained therein, this coating also emitted a bad smell similar to that emitted by water glass.

On the other hand, a still further proposal has been made in Japanese Patent Publication Sho. 61-39589 or in Japanese Patent Laying-Open Gazette Hei. 3-49944. This proposal employs a polyamide resin as the component of hydrophilic coating, in place of the water glass compounds (including silanol). Although the unpleasant smell from this resin coating is weaker than that from the water glass coating, the polyamide resin coating still has the following disadvantages. The coating fails to cause the adherent water to form a desirably thin layer which decreases the air flow resistance through the evaporator. Further, the condensed water stays thereon and is not drained smoothly because of the relatively poor hydrophilicity. Thus, the problem of waterdrop flying remains unresolved. Other prior art teachings are Japanese applications 1-299877 and 64-61239 which suggest further variants.

Further, certain of the present applicants proposed in U.S. Pat. No. 5,152,337 giving the tubular elements a revised shape. The tubular elements for a stack type evaporator made of aluminum were designed therein to improve the drainage of condensed water so as to improve heat transfer and to prevent the waterdrop from flying.

According to our earlier proposal mentioned above, each aluminum tubular element is formed with straight drain canals, which extend in parallel with each other from an upper header portion to a lower header portion of the element. The condensed water is guided along the straight canals towards the lower header portion, and then discharged out of the tubular element. Therefore, the condensed water on the surface of each tubular element is removed smoothly through the straight canals.

The stack type evaporator comprising the tubular elements improved in this way has still to be improved in the following ways.

At first, the relatively poor hydrophilicity of the aluminum surface renders it difficult to completely remove the condensed water sticking to and remaining on the surfaces of aluminum tubular elements. Consequently, there is still the possibility that the waterdrop is scattered from the tubular elements.

Second, the tubular elements emit some smells including a metallic smell from aluminum as the base material of the elements, an unpleasant smell from a chemical undercoating which is always formed to enhance corrosion resistance of aluminum article surfaces, and a smell of mildew which grows in the remaining water sticking to the tubular elements.

OBJECTS AND SUMMARY OF THE INVENTION

An object of the present invention is to provide a stack type evaporator which is improved to suppress both the problem of waterdrop flying and the problem of bad smell, and more particularly, to provide a stack type evaporator which can operate in a pleasant manner when employed in a car air conditioning system.

In an effort to achieve this object, the present inventors have tried to improve the stack type evaporator, which comprises the tubular elements each having straight canals formed thereon in a manner as set forth in their earlier proposal. Their knowledge or recognition, presupposition and discussion on the relevant matters were integrated through their experiments and research which have led to the present invention.

The present inventors considered first the possibility whether the tubular elements having the straight canals would be coated with any appropriate one of the prior art hydrophilic coatings, in such a manner that the problems of the stack type evaporators are resolved.

As a result of their work, they concluded that the structure peculiar to such stack type evaporators having the straight canals would bar the simple application of any prior art hydrophilic coating from resolving all the problems at once.

Contrary to the prior art, they supposed that the dimension or the like factors of the straight canals would affect to a significant extent the draining capacity of the straight canals formed on each tubular element, even if the tubular elements were coated with the hydrophilic coating. Further, they supposed that the hydrophilicity of the coating covering the tubular elements would have a noticeable influence on function of the canals as drainage means.

Based on such suppositions, the present inventors then discussed a desirable structure of the straight canals.

At first, a narrower straight canal coated with the hydrophilic surface layer was considered and the inventors concluded that the following phenomena or tendency would take place. The capillary action occurring between the walls defining each canal would cause the condensed water to be retained in the canal (thus impairing the drainage). The condensed water sticking to and remaining in the canals due to capillary action would occasionally prevent the straight canals from performing as good drainage means. A higher hydrophilicity of the canals would increase the intensity of capillary action, but a poorer hydrophilicity would however cause the condensed water to form small particles (i.e., waterdrop) staying in the straight canals and thus hindering them from serving as good drainage. In summary, the present inventors have concluded and established that due to the capillary action there would be a certain lower limit for the width of straight canals.

Next, a broader straight canal was discussed to lead to the conclusion that the following problems would occur. Canals of a width excessively large as compared with the required capacity of drainage would undesirably increase the overall size of each tubular element. Such large-sized tubular elements apparently could not meet a requirement that those elements which make up the evaporator for car air conditioners must be as small and light as possible and at the same time must be of the highest possible heat exchange efficiency and draining capacity. Thus, the present inventors have concluded that there would be a certain upper limit for the width of straight canals.

Summarizing, the inventors have discovered that the width of straight canals should fall within a specific range in order to improve the drainage through the straight canals, this in combination with the ratio of the surface areas of all straight canals as a whole to an overall surface area of each tubular element.

Another subject which was discussed by them was the problem of bad smell.

The inventors felt that this was complicated because of a mixture of a metallic smell of aluminum as a substrate material, another smell (like a fishy smell of a hardening cement) peculiar to a protective layer composed of anticorrosive oxides and chemically formed to cover the substrate surface, a further smell of a hydrophilic coating, and yet another smell emitted by mildew growing in the sticking water on the outer surface of condenser. In order to keep odorless an operating condenser, it would be necessary to shut out all of these constituent smells.

For that purpose, the inventors regarded it as practical to cover the tubular elements with an appropriate hydrophilic coating which itself is less odorous and capable of sealing not only the bad smell from aluminum as the base metal but also that from the anticorrosive layer. Therefore, they evaluated a variety of the prior art hydrophilic coatings.

The water glass-based inorganic coatings (including those composed of silanol) had been popular as the hydrophilic coating in this field. The coating of this kind emits a bad smell inherent in water glass and resembling the smell of the anticorrosive layer (and also similar to the unpleasant smell of a hardening cement). Therefore, the inventors gave up employing the water glass coating in the evaporators for car air conditioners.

The organic resin coatings which had been known to be less problematic in respect of smell were then evaluated by them. However, the prior art resin coatings of this type has been unsatisfactory due to their poorer hydrophilic property, though less odorous and more effective to suppress the bad smells of the base metal and the anticorrosive layer formed thereon. If any prior art resin coating is employed, then the condensed water would not be able to move smoothly on the less hydrophilic surface towards the straight drain canals, so that they will fail to give full advantage to their draining capacity. On such an occasion, a considerable amount of condensed water will adhere to and remain on the tubular elements whereby mildew will grow thereon to emit bad smell which spoils the air-conditioned environment.

Thus, they discussed that any of the known resin coatings cannot perform in a satisfactory manner as the hydrophilic coating to cover the surfaces of tubular elements each comprising the straight canals, but the resin coatings have to be improved further.

The inventors attained the present invention as a result of their researches and experiments which had been made in a series along the line suggested by their presumptions, analysis and discoveries detailed above. The present invention resides in a combination of three factors, one of them being the use of straight canals, a second being a restricted range of dimensional characteristic of the straight drain canals formed on the tubular elements, and the third factor being a specified chemical composition of the hydrophilic coating which has to cover the tubular elements. These factors are combined with each other in the present invention such that the stack type evaporator shows an excellent drainage of condensed water and scarcely emits any unpleasant or bad smell.

From one aspect of the invention, straight canals for draining the condensed water are formed on and along each of tubular elements, and extend from an upper header portion to a lower header portion of the tubular element so that the condensed water is guided towards the lower header portion and removed from the tubular element. From another aspect, a hydrophilic resin coating covering the surfaces of fin members and the tubular elements is of a hydrophilic property whose degree falls within a restricted range such that the condensed water can move smoothly from the fin members to the tubular elements and from flat portions thereof to the straight canals. The hydrophilic coating does not only not emit any inherent bad smell but also prevent aluminum as the base material and anticorrosive layer chemically formed thereon from emitting any unpleasant smell. Also important in the practice of the present invention is the fact that the straight canals are of a specified width, and also a ratio of the total surface area of the canals to the overall surface area of each tubular element is in a specified range.

A stack type evaporator provided herein thus comprises: a plurality of tubular elements each composed of a pair of facing core plates which are adjoined one to another at their peripheries so as to define a coolant path therebetween; a plurality of fins each interposed between the two adjacent tubular elements which are stacked side by side in a direction of their thickness; upper and lower header portions respectively formed at an upper and lower ends of each tubular element, with the header portions being connected to the other corresponding header portions so as to unite the tubular elements to form the evaporator; a plurality of canals formed on each core plate of the tubular element so as to drain condensed water therefrom; a hydrophilic resin coating covering the outer surfaces of the tubular elements and the fins; the hydrophilic resin coating being applied by immersing the outer surfaces in a solution containing a polyvinyl alcohol resin as its main component as well as polyamide and/or polyvinyl pyrrolidone resins as its hydrophilic agent blended with the main component, a film hardener having a concentration sufficient to produce a hardened coating but not so great as to react with hydrophilic atom groups in the hydrophilic resin molecules and thereby fail to enhance the hydrophilic property, and a surfactant to stabilize the resin solution so that it will not become bubbly; a width of each straight drainage canal covered with the hydrophilic resin coating being included in a range of from about 0.5 to about 3 mm, the width being defined as a distance between surfaces of the resin coating covering an open mouth of the canal; and a surface area ratio falling within a range of from about 5 to about 40%, the surface area ratio being a ratio of a total area of the open mouths to an overall surface area of each core plate, and the overall surface not including expanded end regions of the core plate but inclusive of flat portions and the straight canals thereof, whereby the combination of said parallel drainage canals and said coating in said stack type evaporator results in substantially lower odor and retained water as compared to a coated scattered rib type evaporator.

The hydrophilic resin coating in the present invention is required not to emit its own smell still to suppress the metallic smell of aluminum as the base material of tubular elements and the like and any also to suppress unpleasant smell of the anticorrosive layer chemically formed on the elements.

The hydrophilic resin coating should be hydrophilic to an appropriate degree. If the surface of each straight drainage canal is excessively hydrophilic, then the condensed water will suffer the capillary action which causes it to stay in the canal. If the surface of the canal is hardly hydrophilic, then the condensed water will form waterdrop, that is water particle which causes 'water bridge' also remaining on the canal. In either case, the tubular elements will become difficult to drain.

Thus, the hydrophilic resin coating employed herein to seal the outer surfaces of each tubular element and each fin is required to comprise, as mentioned above, a polyvinyl alcohol resin as its main component, polyamide and/or polyvinyl pyrrolidone resins as its hydrophilic agent blended with the main component. In addition to them, the resin coating should further contain a film hardener contained at a concentration sufficient to harden the resin coating but not so excessively as to react with hydrophilic groups in molecules of the resin and impair its hydrophilic property, and a surfactant for stabilizing the bath of a resin composition so as not to bubble.

If the straight canals each covered with the hydrophilic resin coating are too narrow, then the capillary action will retain the condensed water in the canals. If they are too wide, then the evaporator of this type cannot be made small in size and light in weight, failing to meet requirements. Therefore, the width of each drainage canal should fall within a range of from about 0.5 to about 3 mm, and more preferably within a narrower range of from about 1.3 to about 2.4 mm, wherein the width is defined between the surfaces of the resin coating disposed at an open outermost region of each canal.

Although a greater number of the straight canals may be desired for each tubular element in order to assure excellent drainage, superfluous canals will not give any additional effect. Thus, the ratio (%) in surface area of the straight canals to the overall surface area of each core plate other than its end expansions should be included in a certain range.

Therefore, the ratio of the surface area corresponding to the open outermost regions of the straight canals to the overall flat surface area of each core plate except for its upper and lower expanded portions should fall within a range of from about 5 to about 40%, and more preferably within a narrower range of from about 15 to about 25%.

The depth of each straight canal need not be strictly limited, though it may preferably fall within a range of from about 0.5 to about 2.5 mm, and more preferably from about 1.5 to about 2.1 mm. The depth is defined as a distance between the surface of resin coating covering the flat portion of core plate and the surface of the coating covering the bottom of each straight canal.

The hydrophilic resin coating preferably contains, in addition to those components as mentioned above, a microbicide such as an antibacterial agent, a bactericide or a mold-suppressing agent which inhibit any bad smelling mold or mildew to grow on the surfaces of evaporator.

An advantageous formulation of such a resin coating includes in the range of: from about 30 to about 65 parts by weight of polyvinyl alcohol resin as the main component; from about 20 to about 65 parts by weight of polyamide and/or polyvinyl pyrrolidone resins as the hydrophilic agent; from about 1 to about 15 parts by weight of the film hardener; from about 0.1 to about 2.0 parts by weight of the surfactant; and from about 3 to about 30 parts by weight of the microbicide.

The thickness of the hydrophilic resin coating is preferably included in a range of from about 0.2 to about 1.5 μm, and more desirably from about 0.5 to about 1.3 μm.

Although either polyamide alone or polyvinyl pyrrolidone resin alone suffices as the hydrophilic agent, a mixed solution of them is more advantageous.

The film hardener may either be a phenolic resin or a polyurea resin, though the former is less odorous and therefore more preferable.

A preferable surfactant is a nonionic surface active agent.

The appropriate microbicides include: bis-(2-pyridylthio)-zinc 1,1'-diphoxide; methyl benzimidazole carbamate; and 2-(4-thiazolyl)-1H-benzimidazole.

It will now be apparent that the straight canals to drain the condensed water do extend in parallel with each other, along the outer surface of each tubular element and between the upper header portion to the lower header portion thereof, and that the outer surface of each tubular element having the canals is coated with the hydrophilic resin coating of a specified recipe such that., in combination with the straight canals and in a manner described above, the drainage through the canals is improved by virtue of the moderate hydrophilicity of the coating which is effective to render odorless the evaporator. It is a further important feature that the width and the surface area ratio of the straight drainage canals are provided in accordance with the present invention.

The evaporator provided herein is excellent in drainage of condensed water and consequently resolves the problems of waterdrop flying and bad smell, and thus may advantageously be incorporated in the car air conditioners.

Further objects and advantages of this invention will become clear in the embodiments which will be given hereinafter only by way of examples to demonstrate the preferred modes. Therefore, this invention is not limited to those embodiments but permits many other modifications falling within the range and spirit of the invention.

BRIEF DESCRIPTION OF THE DRAWINGS

The present invention will become more apparent from its embodiments which will be described in detail referring to the accompanying drawings, in which.

DETAILED DESCRIPTION OF THE PREFERRED EMBODIMENTS

Embodiments of the invention which are applied to a stack type evaporator made of aluminum or its alloy for use in a car air-conditioner will now be described in detail.

Figure 7:
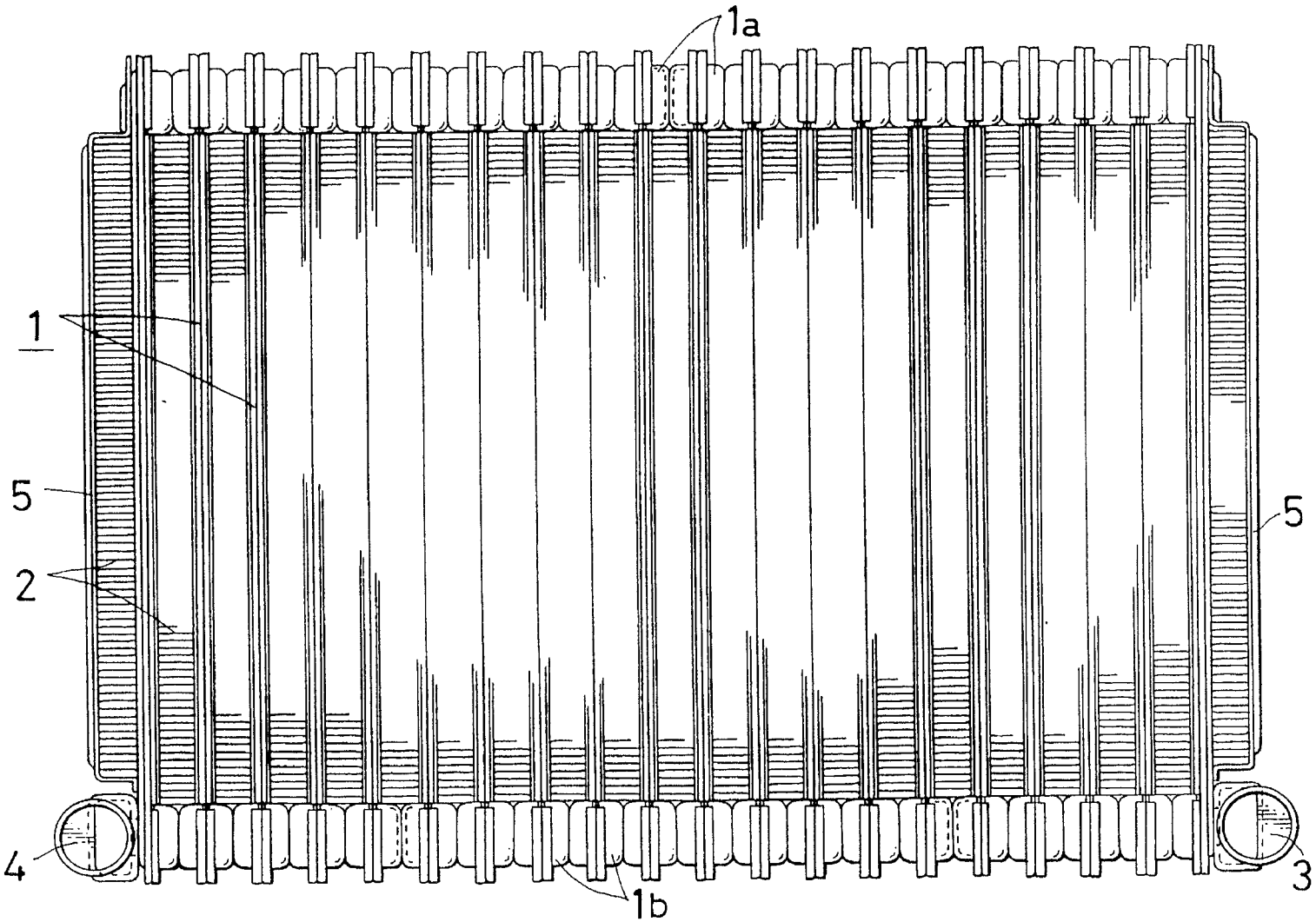
FIG. 7 is a front elevation showing the evaporator in its entirety.

As shown in FIG. 7 in its entirety, the evaporator comprises a plurality of plate-like tubular elements 1 which are disposed upright and stacked side by side. The evaporator also comprises corrugated fin members 2, most of which are interposed between two adjacent tubular elements 1, with the other ones being disposed outside the outer-most tubular elements 1. The corrugated fin members 2 are brazed to the tubular elements so as to be integral therewith.

Each tubular element 1 is, as shown in FIGS. 1 to 7, provided with an upper and lower header portions 1*a* and 1*b* which are bulky and disposed respectively at opposite ends in a longitudinal direction of the element. Unit coolant paths 1*c* extending longitudinally of the element 1 are formed intermediate between and in fluid communication with the header portions 1*a* and 1*b*, the unit coolant paths 1*c* constituting as a whole a flat coolant path. The adjacent tubular elements 1 are tightly combined one with another at their header portions 1*a* and 1*b*, which portions are connected in fluid communication with each other through coolant-flowing openings 1*d*.

Each tubular element 1 is made by arranging two dish-like core plates 6 into an inside-to-inside relation and by subsequently brazing them at their peripheries 6*a* to be integral with each other. The core plates 6 are manufactured by the pressing of a brazing sheet which comprises a core sheet having its front and back surfaces covered with a brazing agent layer. The brazing agent layer is applied by the cladding technique so that the core plates 6 are easily brazed together and also brazed to the adjacent corrugated fins 2.

Figure 6:
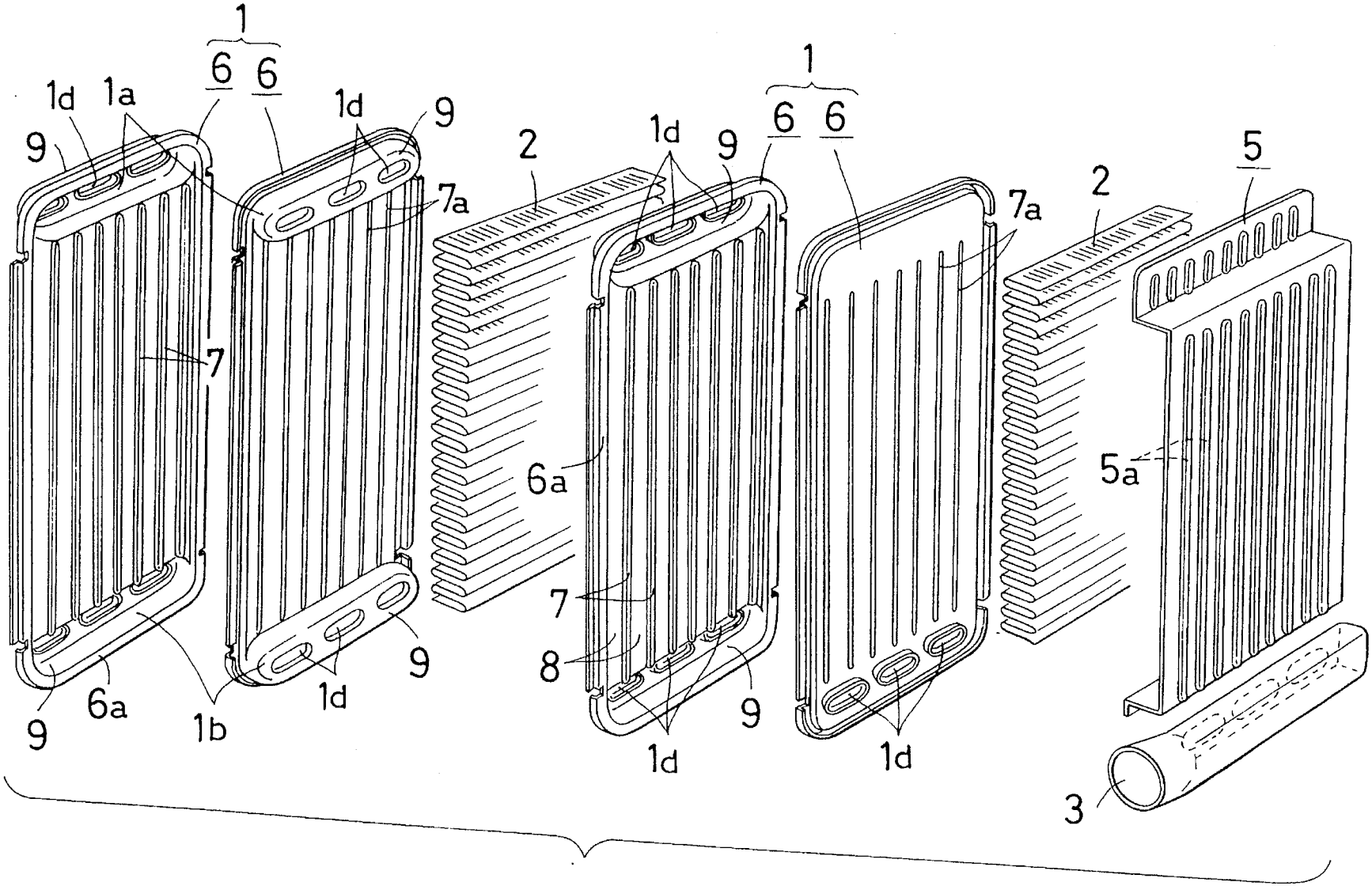
FIG. 6 is a perspective view showing a section of the evaporator, in its state separated from remaining portions thereof.

End portions of each core plate 6, except for outer core plates 6 constituting the outermost tubular elements 1, respectively protrude outwardly to provide expanded portions 9. Each outer core plate 6 has, as shown in FIG. 6, both ends formed flat and comprising three coolant-flowing openings 1*d* arranged in a transverse direction.

Three other coolant-flowing openings 1*d* pierce a ridge of each expanded portion transversely of the core plate, so that the header portions of adjacent tubular elements 1 communicate with each other. However, as shown in FIG. 7 illustrating an entirety of this evaporator, there are no such openings 1*d* through the contacting side walls of expanded portions 9 which belong to the lower header portions 1*b* of the fifth and sixth tubular elements 1, counted from the right end. Also, there are not provided such openings 1*d* through contacting side walls of expanded portions belonging to the upper header portions 1*a* of the tenth and eleventh tubular elements 1. Similarly, there are no such openings 1*d* through the contacting side walls of expanded portions 9 which belong to the lower header portions 1*b* of the fifteenth and sixteenth tubular elements 1. Those side walls of expanded portions which are not pierced by any openings do function as partitions disposed between the adjacent expanded portions.

As shown in FIG. 7, each corrugated fin 2 is interposed between the adjacent tubular elements 1, which are brazed together in this state due to the brazing agent layer mentioned above. A coolant inlet pipe 3 is connected to the lower header portion 1*b* of right-hand outermost tubular element 1, in fluid communication therewith. A coolant outlet pipe 4 is connected likewise to the lower header portion 1*b* of left-hand outermost tubular element 1, also in fluid communication therewith.

Figure 8:
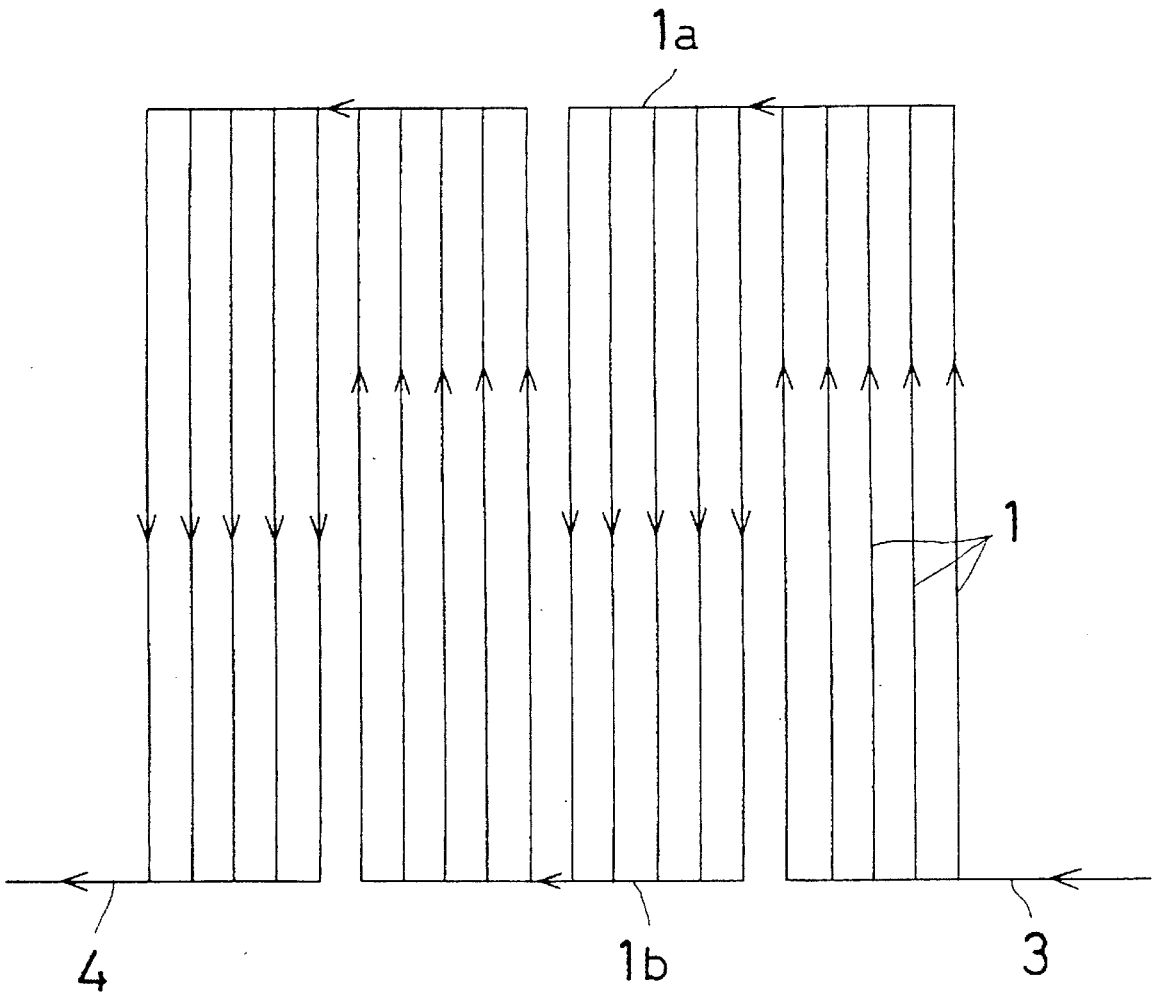
FIG. 8 illustrates a coolant flow.
Figure 9:
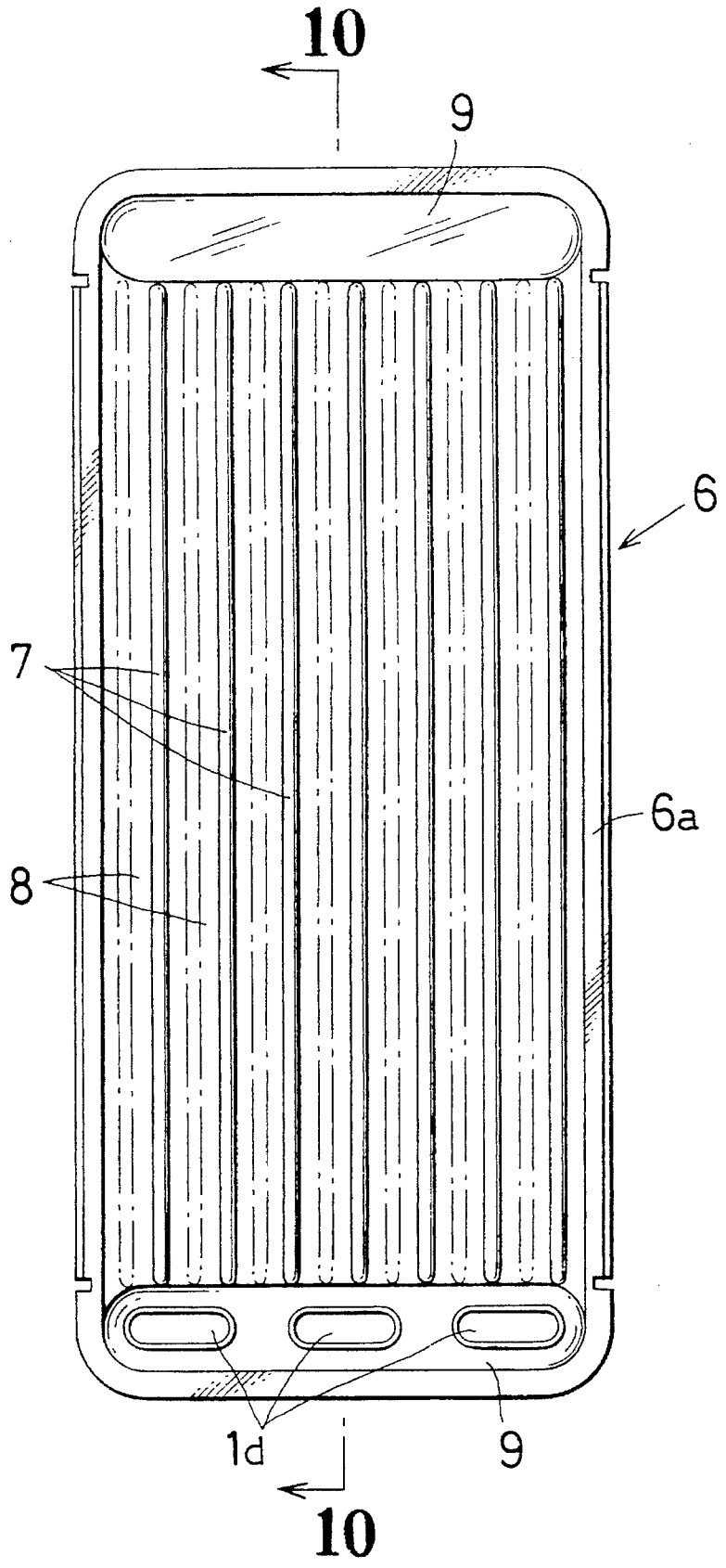
FIG. 9 is a plan view of a core plate which forms a partition disposed in the header portion.
Figure 10:
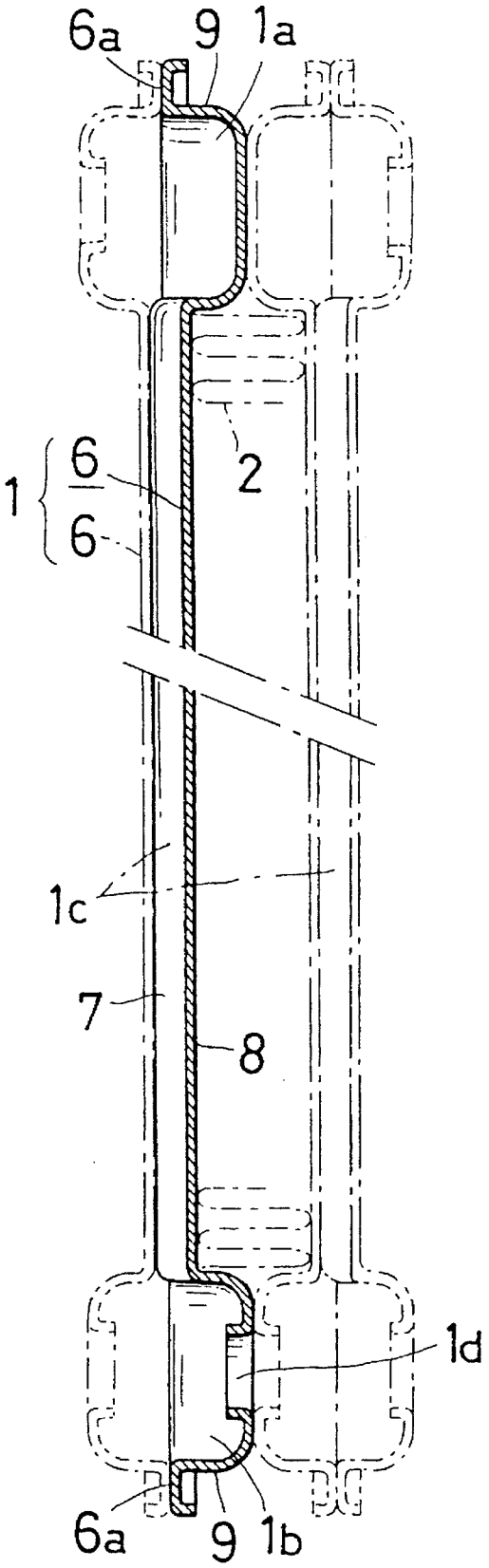
FIG. 10 is an enlarged cross section taken along the line 10—10 in FIG. 9.
Figure 11:
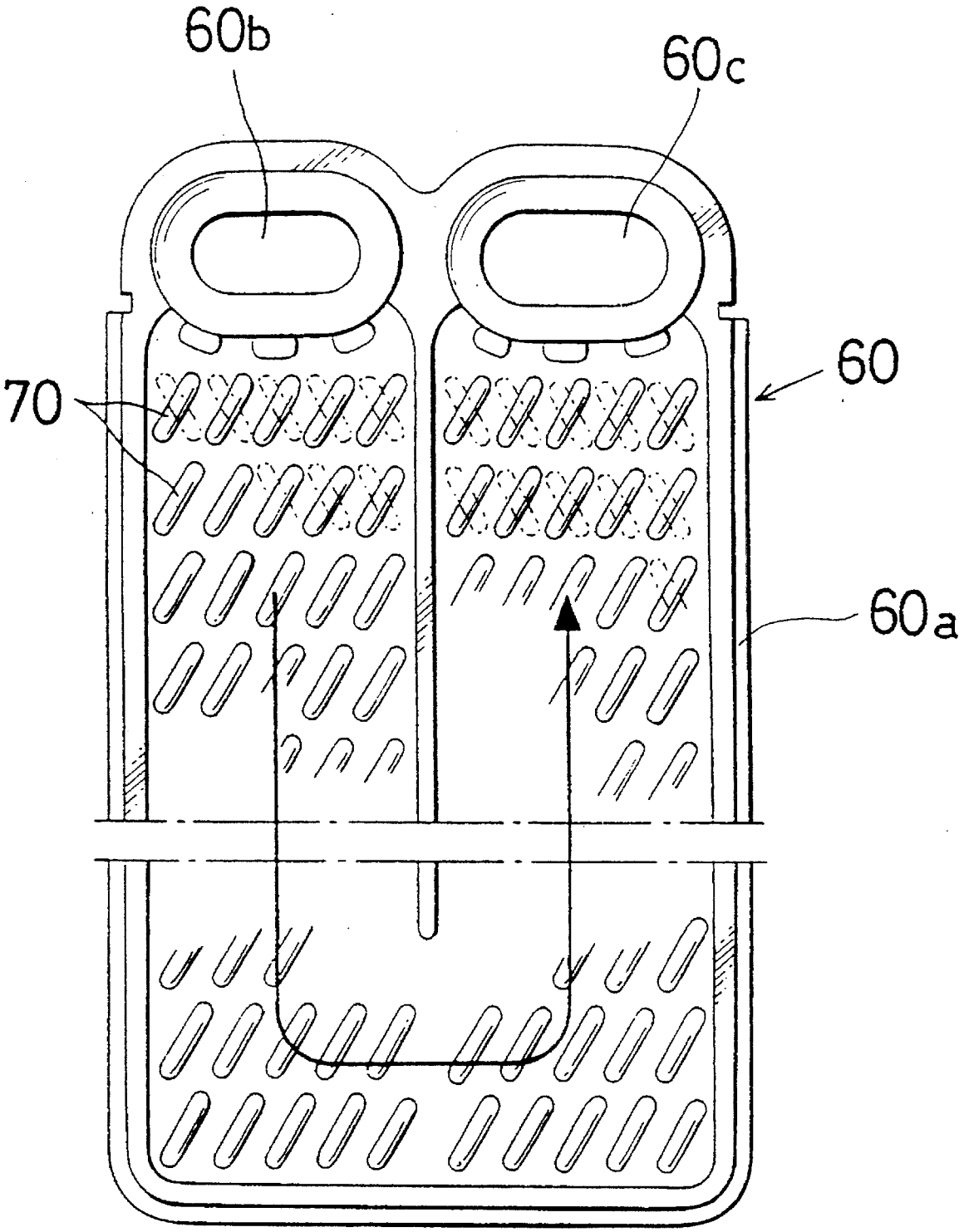
FIG. 11 PRIOR ART
FIG. 11 is a plan view of the prior art core plate, seen from the side of a unit coolant path formed therein.

Due to the partitions mentioned above, the coolant entering the evaporator through the inlet pipe 3 is caused to advance in a zigzag pattern, as shown in FIG. 8, changing its flow direction at every boundary between adjacent groups of the tubular elements, before the coolant leaves the evaporator through the outlet pipe 4. Thus, heat exchange is effected between the coolant flowing in this way and air streams passing through air paths, each air path being formed in a gap between the adjacent tubular elements and including the intervening fin member 2. The reference numeral 5 in FIGS. 6 and 7 denotes a side plate disposed outside the outermost corrugated fin member.

The "groups" in this embodiment comprise the same number of the tubular elements 1, whereby an excellent property of heat exchange is enhanced to the evaporator. However, the total number of the tubular elements may occasionally make it impossible to divide them into the groups of even number of constituent tubular elements. In a case wherein the inlet and outlet pipes 3 and 4 are connected to the lower portions of the outermost tubular elements, despite the uneven numbers of said elements in the groups, it is desirable to constitute one of the groups connected to the inlet with a larger number of said elements than the other groups. There may be another case in which it is desirable to increase the number of tubular elements progressively from the group for the inlet towards the other group for the outlet. Details will be decided in such a case to gradually increase the substantial cross-sectional area of the coolant path towards the outlet, taking into account the total number of said elements, the number of U-turns made by coolant, the positions where the inlet pipe 3 and outlet pipe 4 are connected to the evaporator body, or other conditions. In other words, the most desirable grouping of the tubular elements should be employed in consideration of all the relevant conditions.

Figure 1:
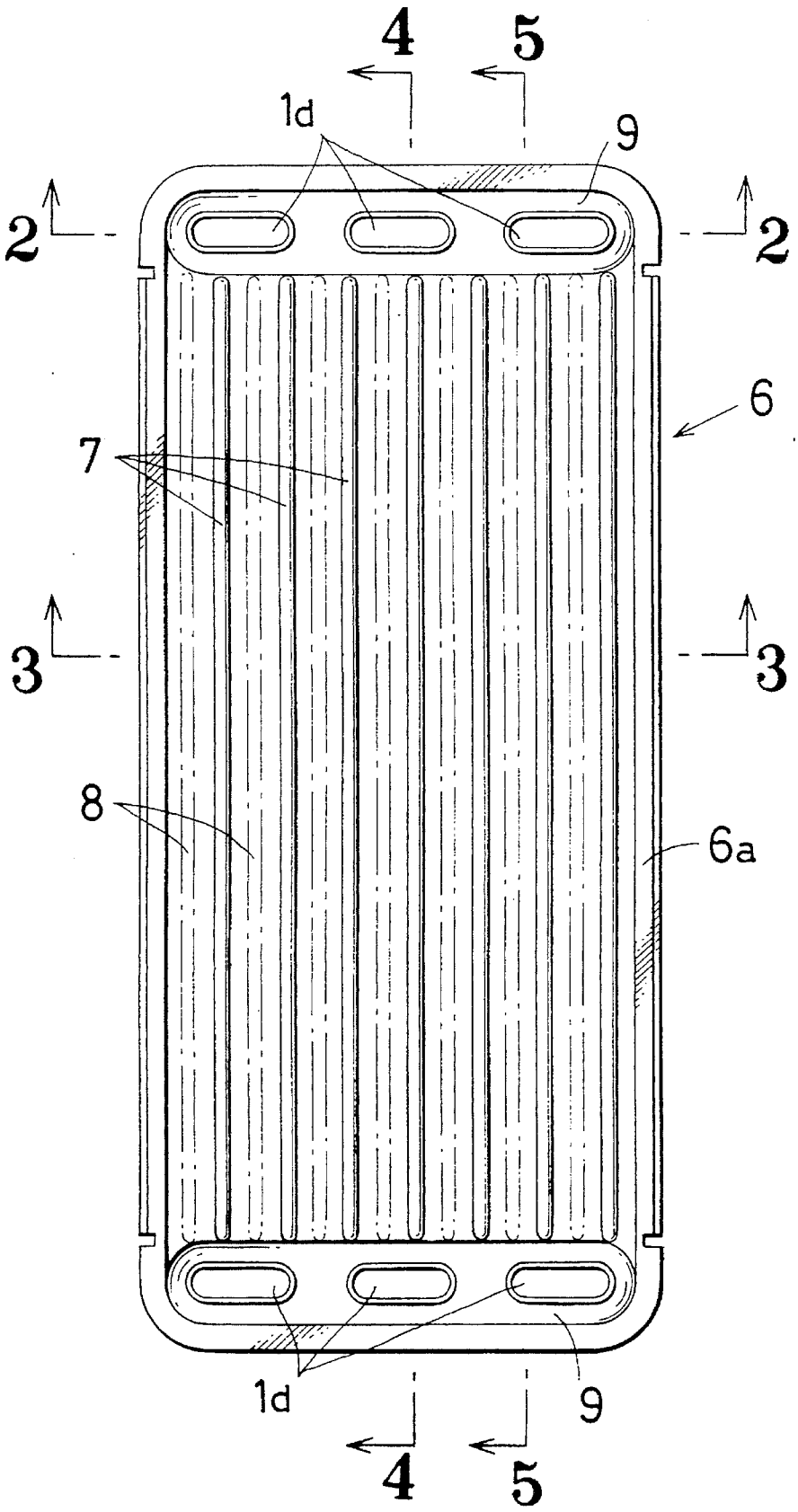
FIG. 1 is a plan view of a core plate constituting an evaporator in an embodiment, seen from the side of unit coolant paths.
Figure 2:
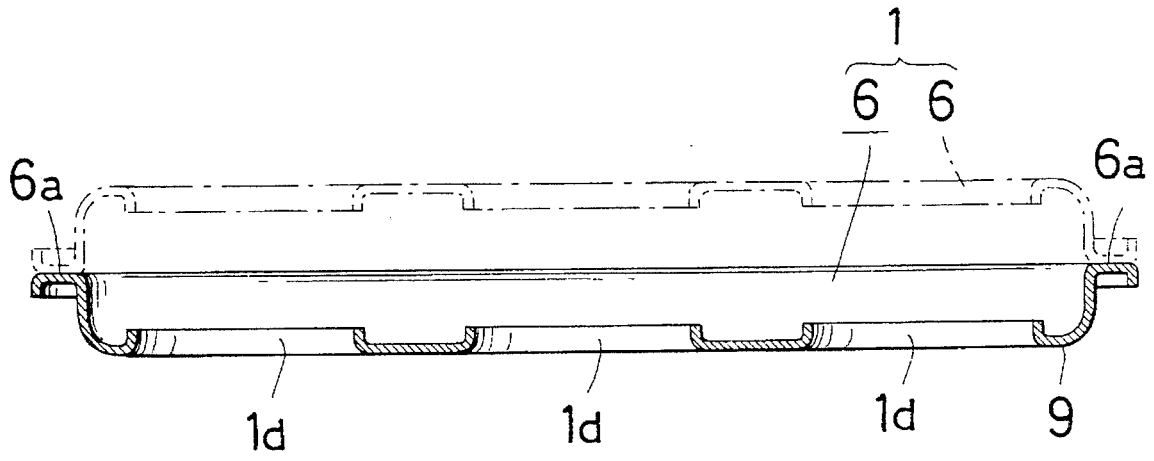
FIG. 2 is an enlarged cross-sectional view taken along the line 2—2 in FIG. 1.
Figure 3:
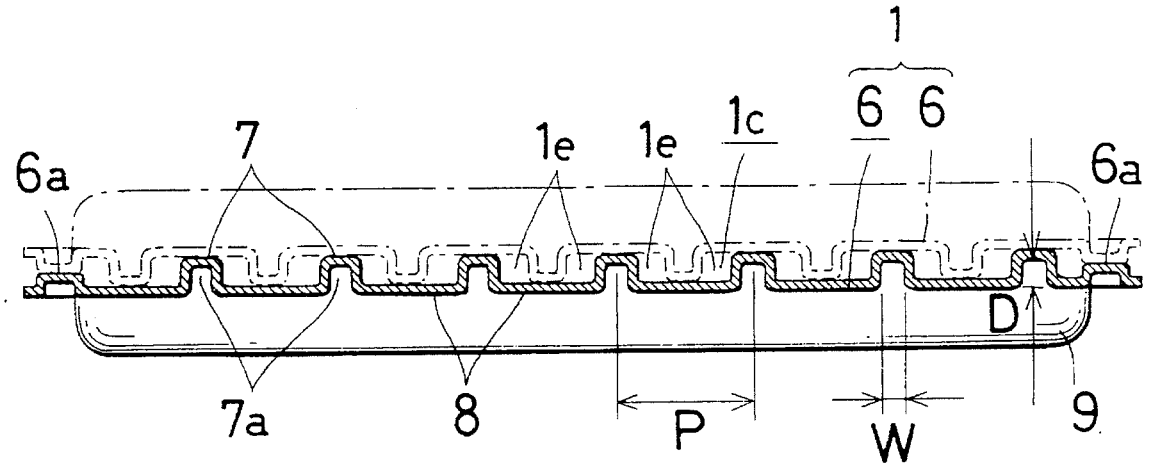
FIG. 3 is another enlarged cross-sectional view taken along the line 3—3 in FIG. 1.
Figure 4A:
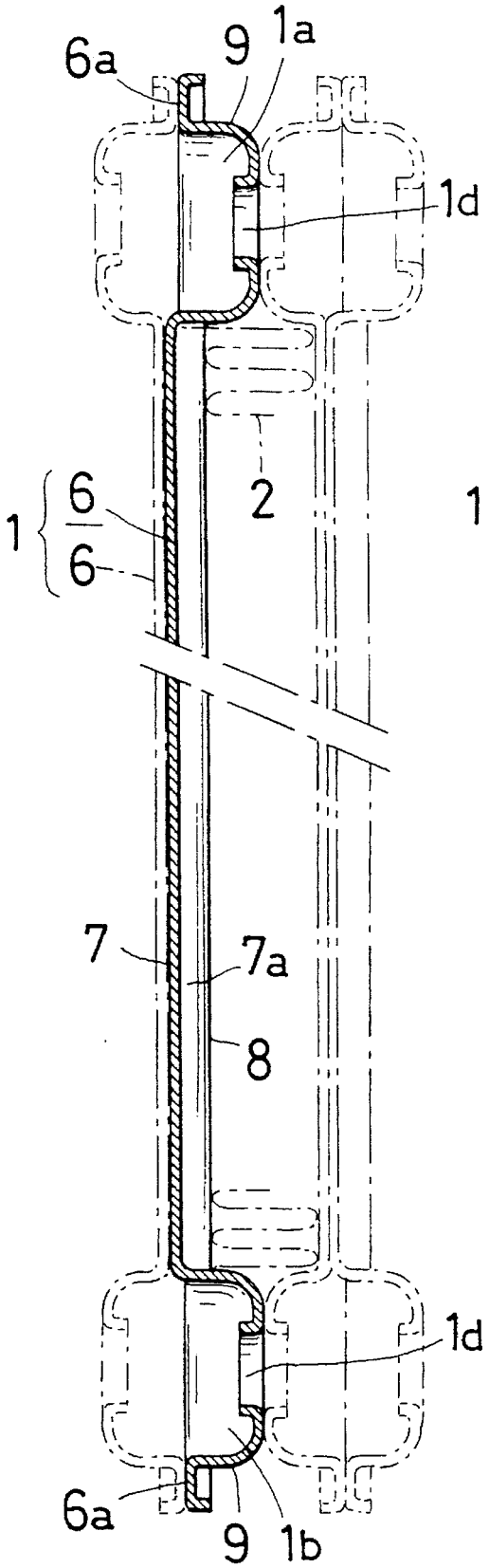
FIG. 4A is a further enlarged cross-sectional view taken along the line 4—4 in FIG. 1.
Figure 4B:
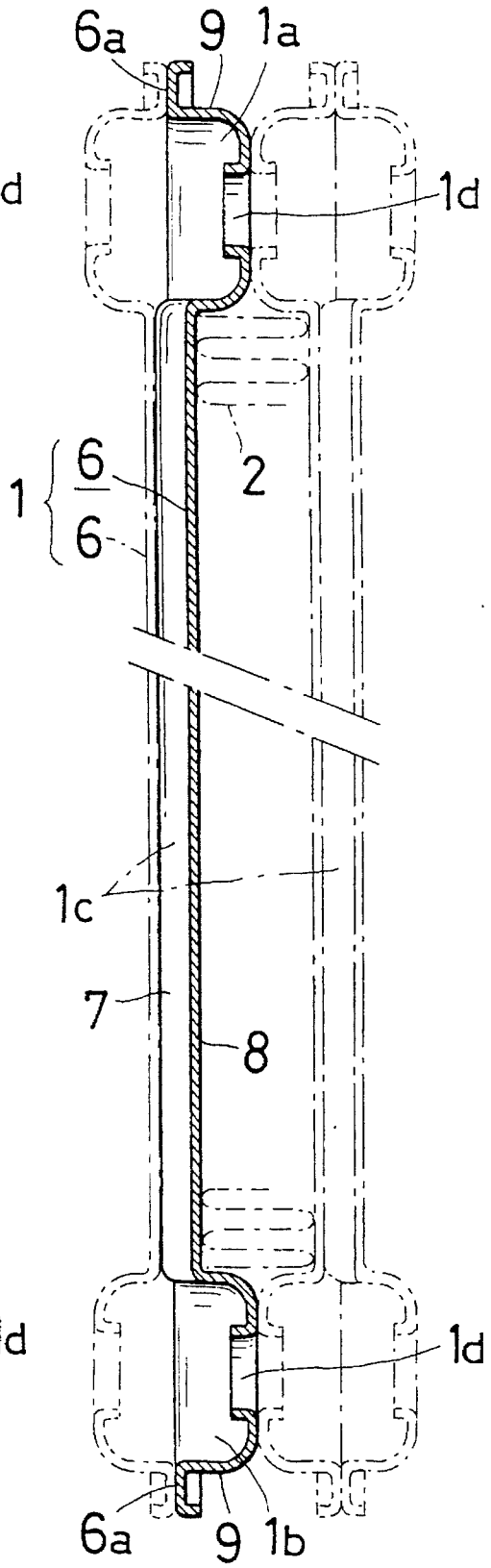
FIG. 4B is a still further enlarged cross-sectional view taken along the line 5—5 in FIG. 1.

As shown in FIGS. 1, 3 and 6, recessed ribs 7 are formed on inner surface of each core plate 6, between its two expanded portions 9, and at regular intervals transversely of the core plate. The positions of recessed ribs are however offset transversely towards one of the longitudinal sides of the core plate. The inwardly protruding recessed ribs 7 which extend straight from one expanded portion 9 to the other one will function as straight drainage canals, as will be detailed later. Two core plates 6 having the ribs 7 are brought into close contact and are brazed at their peripheries 6*a* integral with one another. As seen in FIGS. 1 and 3, the ribs 7 of one core plate 6 shown by said lines and those of the other core plate shown by phantom lines which alternate with each other. Inner end surfaces of the ribs 7 of one core plate 6 tightly engage with and are brazed to flat portions 8 between two adjacent ribs 7 of the other core plate, whereby a plurality of unit coolant paths 1*e* are defined straight from the delivery header portion 1*b* to the return header portion 1*a* within the coolant flow path 1*c* of each tubular element 1. Alternatively the ribs 7 of one core plate 6 may be in alignment with and brazed to the corresponding ribs 7 of the other core plate 6 facing the one core plate, so that a plurality of unit coolant paths 1*e* are similarly defined straight from the delivery header portion 1*b* to the return header portion 1*a* within the coolant flow path 1*c* of each tubular element 1.

Thus, a plurality of straight drainage canals 7*a* are defined by the inwardly protruding recessed ribs 7. In order to improve the drainage of condensed water, it is desirable and effective that the straight canals are covered with a resin coating which is of a moderate hydrophilic property. The moderate hydrophilicity is such that the capillary action will neither cause retention of a remarkable amount of condensed water nor allow it to form waterdrops within the canals, the waterdrop formation rendering drainage difficult. As will be detailed later, this hydrophilic resin coating is composed of a polyvinyl alcohol resin as main ingredient, a polyamide and/or polyvinyl pyrrolidone resins as a hydrophilic agent, a film hardener and a surfactant.

Both the tubular elements and the fins are coated with such a hydrophilic resin coating.

The straight canals 7*a* thus covered with the hydrophilic coating must have a width "W" as illustrated in FIG. 3, and an "area ratio (%)" of the canals advantageously must fall within a range given below. The area ratio (%) is defined herein as a ratio of surface areas of open outer ends or mouths of the straight canals 7*a* to an entire surface area of a plane region of each core plate 6 exclusive of its expanded end portions 9. The entire surface area is a sum of the surface areas of flat portions 8 and the open areas of the mouths of the straight canals 7*a*.

The width "W" of straight canals advantageously should fall within a range of from about 0.5 to about 3 mm. If the straight canals are narrower than about 0.5 mm, the condensed water is not only incapable of smoothly flowing into the canals but also tends to stay therein due to capillary action, thereby significantly impairing drainage. If, contrarily, the canals are broader than about 3 mm, then the coolant unit flow paths 1*e* are made too narrow to keep the coolant pressure loss below a permissible upper limit. The most preferable range of the width is thus from about 1.3 mm to about 2.4 mm.

The width "W" given above is defined as a distance between the surfaces of the resin coating covering the open end portions of each canal.

The area ratio (%) of the surface areas of open mouths of the straight canals 7*a* to the entire surface area of each core 6, not including the expanded portions 9 and but being the sum of the surface areas of flat portions 8 and the open mouth areas of the straight canals 7*a*, advantageously must fall within a range of from about 5 to about 40%.

Figure 12:
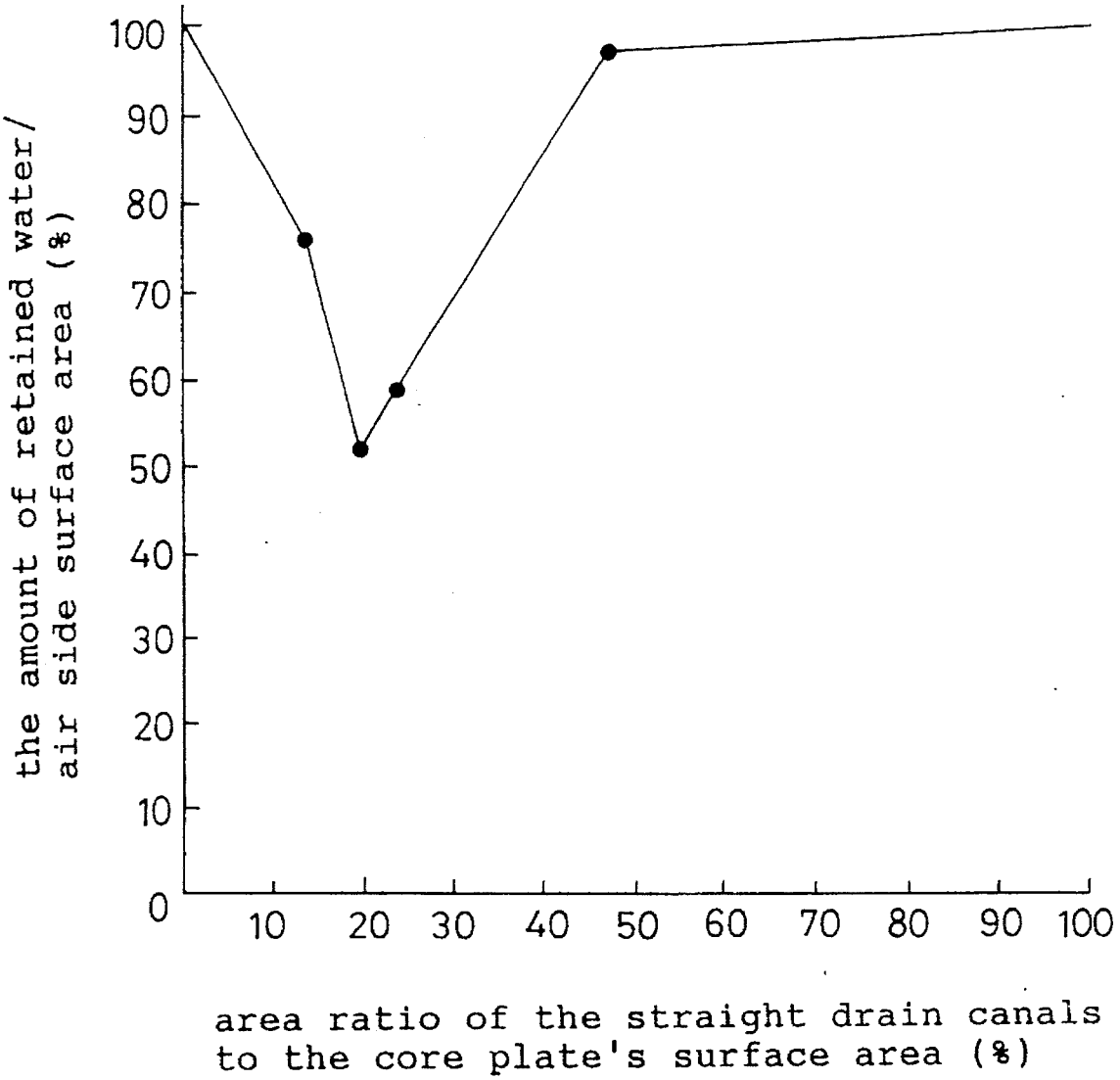
FIG. 12 is a graph showing a relationship between an "area" ratio (%) and an "amount" ratio (%) of water retained on the core plate 6 wherein the "area" ratio is a ratio of area of straight drainage canals to an entire surface area of the core plate, from which both side expanded portions are subtracted; and the "amount" ratio is a ratio of the retained water amount: to an outer surface area of the core plate in contact with air, and is given in % by taking as a standard (i.e., 100) a value for a case in which no canals are formed on the core plate.

If the area ratio is less than about 5% or higher than about 40%, then the amount of retained water increase to such an extent that the straight canals can no longer act as good drainage. A graph in FIG. 12 shows a relationship between the area ratio of straight canals and the amount of retained water for a unit surface in contact with air, with '100%' denoting a value representing a case wherein no canals are formed on the core plate. In addition to failing to serve as the straight grooves for drainage, the drainage canals having the area ratio above about 40% render the flow path 1*c* too narrow to maintain the pressure loss of coolant below a permissible limit. The most desirable ratio is from about 15 to about 25%. The amount of retained water in the graph means an amount of water retained by tested evaporators which are immersed in a water vessel and weighed 30 minutes after withdrawal therefrom.

The depth "D" of the canals 7*a* having surfaces covered with the hydrophilic resin coating preferably falls within a range from about 0.5 to about 2.5 mm. A distance between the resin coating covering the flat portions 8 of the core plate 6 and the resin coating covering the surface of a bottom of each canal 7*a* is defined as the depth "D".

If the canals are made shallower than about 0.5 mm, then the unit flow paths 1*e* become too small to keep the coolant pressure loss below the permissible limit, and the condensed water cannot flow at a sufficient rate through such shallow canals, thus the straight canals failing to function as drainage grooves. With the canals being made deeper than about 2.5 mm, the hydraulic diameter of the unit flow paths 1*e* will be too large to ensure a desirable heat exchange efficiency, and at the same time the capillary action will cause a more amount of condensed water to stay in the straight canals 7*a*, thereby impairing the draining capacity thereof. The most desirable range of said depth is thus from about 1.5 to about 2.1 mm.

The cross section of the inwardly protruding recessed ribs 7 need not necessarily be of such a rectangular shape as shown in FIG. 3, but may be of a trapezoid shape having a width gradually reduced or increasing towards its inner bottom, or any other shape. However, the illustrated shape in this embodiment is desirable for ensuring the good drainage function of the straight canals.

The side plates 5, which are disposed outside the outermost corrugated fins 2, comprise a plurality of groove-like recesses 5*a* formed on their inner surfaces. The recesses 5*a* extend vertically in parallel with one another so as to provide another plurality of additional vertical drainage canals between the outermost fins and the side plates secured to the outer surface thereof. Therefore, the water condensed in the clearances between the outermost tubular elements and the side plates flows downwards through the additional canals, whereby drainage is improved also for those air paths defined through said clearances.

Figure 5:
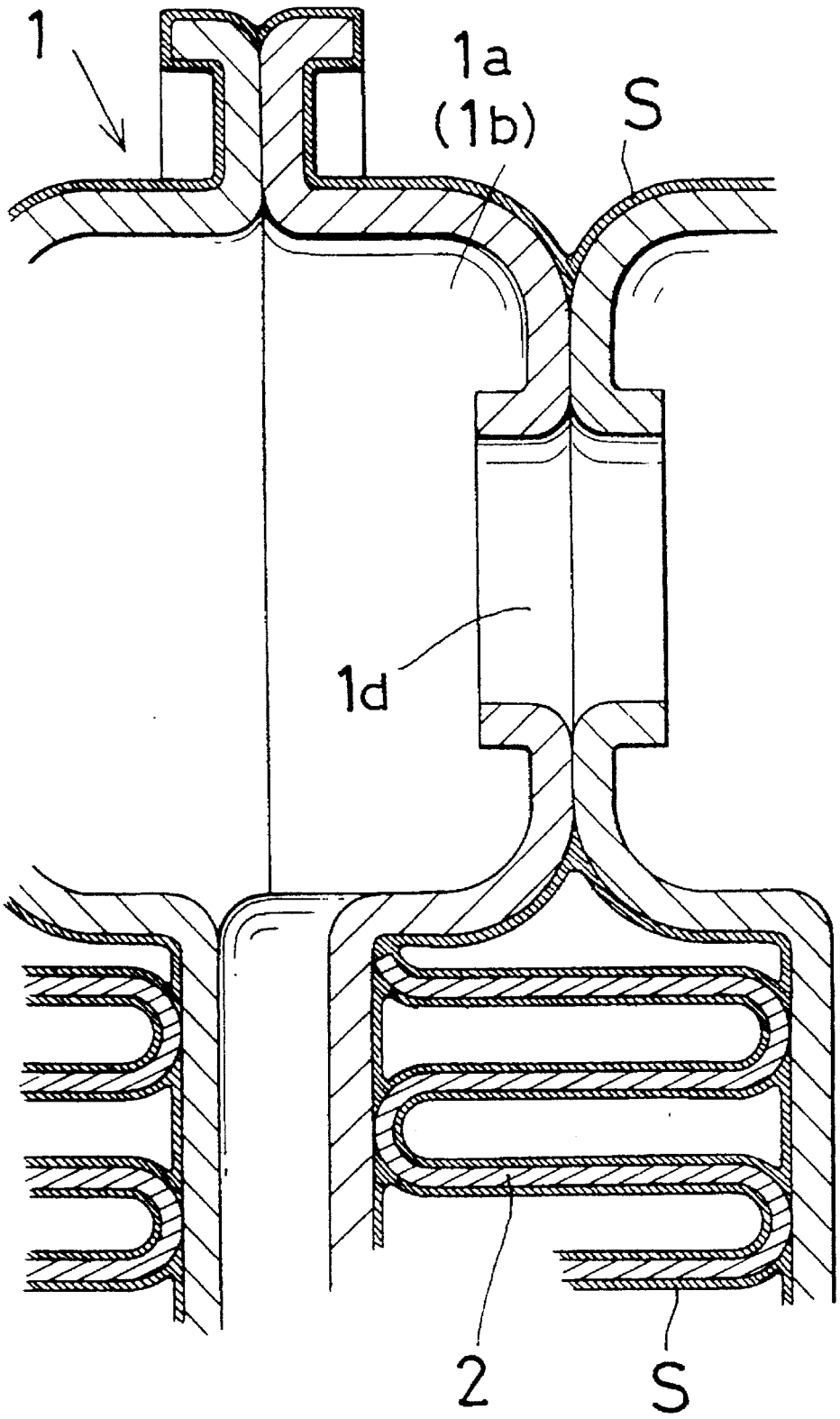
FIG. 5 is an enlarged cross-sectional view of a tubular element's portion including and adjacent to a header portion.

In this embodiment, a coating "S" composed of the hydrophilic resin covers the surfaces of the tubular elements 1, the corrugated fins 2 and the side plates 5, as illustrated in FIG. 5.

The hydrophilic resin composition must comprise, as already mentioned above, a polyvinyl alcohol resins as the main component and is blended with a polyamide and/or polyvinyl pyrrolidone resins, a film hardener and a surfactant, for the following reasons.

Firstly, this resin composition is free from an unpleasant smell which the conventional water glass coatings and the other known hydrophilic coating which is silanol-based and thus included in the former, have been emitting to impair the environment within an automobile interior. In other words, the air-conditioned interior of automobile can be maintained pleasant if the resin coating provided in the invention is used as the coating of the evaporator.

Secondly, resin coating of such a composition can also prevent the underlying layer (which is chemically formed on base material and contains oxides) from emitting its odor. Thus, the problem of the smelling evaporator is resolved more completely.

Thirdly, such a resin coating as provided together with the straight drainage canals 7*a* in the invention is advantageous in that the canals can function more effectively as the grooves for drainage. The prior art water glass coating, is hydrophilic to an excessive degree such that the condensed water tends to stay in the canals due to the capillary action, thus impairing drainage. The prior art resin coating, on the other hand, causes the condensed water to be less adherent and less mobile so that the straight canals 7*a* are hindered from performing their function, also failing to prevent the problem of waterdrop flying. The novel resin coating in the present invention is of a nature intermediate the water glass coating and the prior art resin coating, whereby the straight drainage canals 7*a* can perform their draining function to a satisfactory degree.

The polyvinyl alcohol resin as the main component of said hydrophilic resin may be blended either with polyamide resin, or with a polyvinyl pyrrolidone resin. However, it is more desirable that both of the polyamide and polyvinyl pyrrolidone resins are added to the polyvinyl alcohol resin in order that the resin coating has a better initial hydrophilic property as well as a better durability thereof.

The film hardener is added to the resin composition in order to adjust the hardness of the resin coating formed using the composition. A phenolic resin or a polyurea resin is preferred as the film hardener, and the former is more suited because it is less odorous.

The surfactant is added to a resin composition bath in which the evaporator parts are immersed to form the resin coating, for the purpose of stabilizing the bath not to bubble. A nonionic surface active agent or the like is preferred as the surfactant.

The preferable content of the polyvinyl alcohol resin, hydrophilic agent, film hardener and surfactant are respectively from about 30 to about 65 parts, from about 20 to from 65 parts, from about 1 to about 15 parts and from about 0.1 to about 2.0 parts, all by weight. The reasons therefor are as follows.

If the content of polyvinyl alcohol resin, which is contained as the main component to be a base material of the hydrophilic resin coating, is below about 30 parts by weight, then the coating will not be hydrophilic to a sufficient degree and also will be too thin to have the microbicide dispersed therein. A higher content thereof above about 65 parts by weight however raises the manufacture cost of the hydrophilic coating, and at the same time impairs its hydrophilic property. A more desirable content of the polyvinyl alcohol resin is therefore from about 40 to about 60 parts by weight.

If the content of hydrophilic agent, which is added to improve the hydrophilic property of the resin coating, is below about 20 parts by weight, then the coating cannot be hydrophilic to a sufficient degree. A content exceeding about 65 parts by weight of said hydrophilic agent causes a superfluous solubility of the resin coating. In a case wherein the microbicide is contained, it will be lost when the coating is dissolved, thus failing to prevent growth of the mold or mildew. A more desirable content of said hydrophilic agent is from about 35 to about 45 parts by weight.

If the film hardener is contained at a poor content below about 1 part by weight, then an unhardened coating will be produced, whereas a rich content above about 15 parts by weight will cause its reaction with the hydrophilic atom groups in the hydrophilic resin molecules, consequently failing to enhance the hydrophilic property. A more desirable content of the film hardener is thus from about 5 to about 10 parts by weight.

A content below about 0.1 parts by weight of the surfactant is too poor to prevent the resin composition bath from bubbling and also too poor to disperse the microbicide homogeneously in the resin coating. An excessive content above about 2.0 parts by weight of surfactant will also produce: many bubbles in resin solution, resulting in an uneveness of the hardened resin coating. A more desirable content of the surfactant is therefore from about 0.5 to about 1.5 parts by weight.

In order to prevent the mildew from growing in the adherent condensed water and thus to suppress the bad smell, the resin composition may preferably contain further the microbicide, which may be: bis-(2-pyridylthio)-zinc 1,1'-diphoxide; methyl benzimidazole carbamate; or 2-(4thiazolyl)-1 H-benzimidazole.

The microbicide includes in this specification an antibacterial agent, bactericide, mold-suppressing agent or the like. The surfactant mentioned above is effective also to disperse such a microbicide within the resin solution.

From about 3 to about 30 parts by weight of the microbicide may be added to said resin. Although a low content below about 3 parts by weight is not effective to completely prevent the breeding of mildew, an excessive content above about 30 parts by weight can produce a white powder of the microbicide on the surface of evaporator. Such a powder is likely to fly and enter the air-conditioned automobile room, thus impairing its comfortableness. Therefore, a more desirable content is from about 5 to about 15 parts by weight.

Thickness of the abovedescribed hydrophilic resin coating "S" is preferably from about 0.2 to about 1.5 μm. A resin coating thinner than about 0.2 μm cannot perform the functions needed to the hydrophilic coating, but with a thickness more than about 1.5 μm an inherent odor of the resin itself becomes conspicuous. A more desirable range of the thickness is from about 0.5 to about 1.3 μm.

The hydrophilic resin coating "S" may be formed for example in the following manner.

After assembling to achieve the described structure, the stack type evaporator is subjected to a pretreatment, an acid washing process and a rinsing process, in this order and under usual conditions. Then, a chromate primer is formed on the thus prepared surface, by an appropriate process using a mixed solution of phosphate and chromate compounds or using a solution of an appropriate chromate compound. This primer will give to the surface a higher corrosion resistance and enable the resin to closely adhere to the surface.

Subsequent to those treatments, the stack type evaporator will be washed by being successively submerged in a hydrophilic resin solution of such a recipe as described above. An unhardened resin coating is formed on the surface in this way, and finally, the evaporator is subjected to a baking process to harden and finish the coating.

A surprising effect provided by the invention was confirmed in the following tests. At first, six samples of the stack type evaporators were prepared which were basically the same as those described above in the embodiment. Those samples were either of the one-sided header type or both-sided header type, and comprised different kinds of the recesses on their tubular elements, and different kinds of, or no hydrophilic coatings, as shown on Table 1.

Their draining property and odor were tested by the methods described below to give a result shown on Table 2. In addition, an amount of retained water per unit area of heat conducting surface in contact with air was also measured. Values obtained by the latter test are given also on Table 2, represented % of the value for the sample No. 1.

In the test of the draining property, those samples were immersed in water, withdrawn therefrom to stand for 30 minutes and were subsequently weighed for measurement of the quantity of retained water at that point of time (corresponding to an operation state in actual use). The reference symbols "○", "Δ", "X" and "XX" on Table 2 respectively indicate: a little amount of retained water, without a possibility of causing the waterdrop flying; a greater amount of retained water, but scarcely causing the waterdrop flying; a significant amount of locally retained water, likely to cause the waterdrop flying; and, a remarkable amount of retained water, inevitably causing the waterdrop flying.

TABLE 1

| Sample Nos. | 1 | 2 | 3 | 4 | 5 | 6 |
|---|---|---|---|---|---|---|
| Tube's header | both-sided | one-sided | one-sided | both-sided | both-sided | both-sided |
| Dimension (mm) | 227 W × 235 L × 75 T | 245 W × 225 L × 90 T | one-sided | 227 W × 235 L × 75 T | both-sided | both-sided |
| Ef. front area ($m^2$) | 0.046 | 0.048 | one-sided | 0.046 | both-sided | both-sided |
| Heat ex. area con. air ($m^2$) | 3.18 | 4.35 | one-sided | 3.18 | both-sided | both-sided |
| Tube pitch (mm) | 10.8 | 13 | one-sided | 10.8 | both-sided | both-sided |
| Fin pitch (mm) | 2.0 | 1.8 | one-sided | 2.0 | both-sided | both-sided |
| No. of passes | 4 | 3 | one-sided | 4 | both-sided | both-sided |
| Tubes per pass | 5-5-5-5 | 5-6-7 | one-sided | 5-5-5-5 | both-sided | both-sided |
| Recessed ribs | straight | scattered | one- | straight | both- | both- |

TABLE 1-continued

| Sample Nos. | 1 | 2 | 3 | 4 | 5 | 6 |
|---|---|---|---|---|---|---|
| Dim. of str. canal or rib (mm) | 2.1 W × 1.8 D | 2.0 W × 1.0 D × 19.5 L | one-sided | 2.1 W × 1.8 D | both-sided | both-sided |
| Pitch of str. canal or rib (mm) | 9.4 | — | — | 9.4 | both-sided | both-sided |
| Area ratio of str. canal | 19.6% | — | — | 19.6% | both-sided | both-sided |
| Hydrophl. coating | Invention | Water glass | Prior art resin | None | Water glass | Prior art resin |
| Composition* | PVA 45 pbw etc.** | $K_2O/SiO_2$ 35 pbw[2] etc.*** | PA 98 pbw etc.**** | — | $K_2O/SiO_2$ 35 pbw[2] etc.*** | PA 98 pbw etc.**** |
| Contact angle (θ) # | 7–13 | ≦5 | 30–40 | 50 | ≦5 | 30–40 |
| Weight (Kg) | 1.8 | 2.0 | 2.0 | 1.8 | 1.8 | 1.8 |

Notes for Table 1:
ef. = effective,
ex. = exchanging,
con. = in contact with,
Dim. = Dimension,
str. = straight,
W = width,
L = length,
T = thickness,
D = depth,
Hydrophl. = Hydrophilic,
*= composition of the coating,
pbw = parts by weight,
# = θ of the coating,
etc.**= 18 pbw of polyamide + 18 pbw of polyvinyl pyrrolidone + 9 pbw of phenolic resin + 1 pbw of nonionic surfactant + 9 pbw of bis-(2-pyridylthio)-zinc 1,1'-diphoxide,
etc.***= 65 pbw of polyamide,
etc.**** = 2 pbw of hardener,
PVA = polyvinyl alcohol resin,
PA = polyamide resin.

TABLE 2

| Sample Nos. | Invention 1 | Reference 2 | Reference 3 | Reference 4 | Reference 5 | Reference 6 |
|---|---|---|---|---|---|---|
| Ribs | straight/ | scat./ | scat./ | straight/ | straight/ | straight/ |
| Hydr. coating | novel resin | water glass | prior a. resin | none | water glass | prior a. resin |
| Drainage | ○ | XX | XX | X | ○ | Δ |
| Odor | ○ | XX | X | XX | XX | Δ |
| Amount of retained water (%)* | 100 | 200 | 218 | 124 | 104 | 114 |

Notes:
"scat." = scattered,
"Hydr." = Hydrophilic,
"novel resin" = a hydrophilic resin provided in the invention,
"prior a. resin" = prior art resin, and
*= Amount of retained water per unit area in contact with air.

Figure 13:
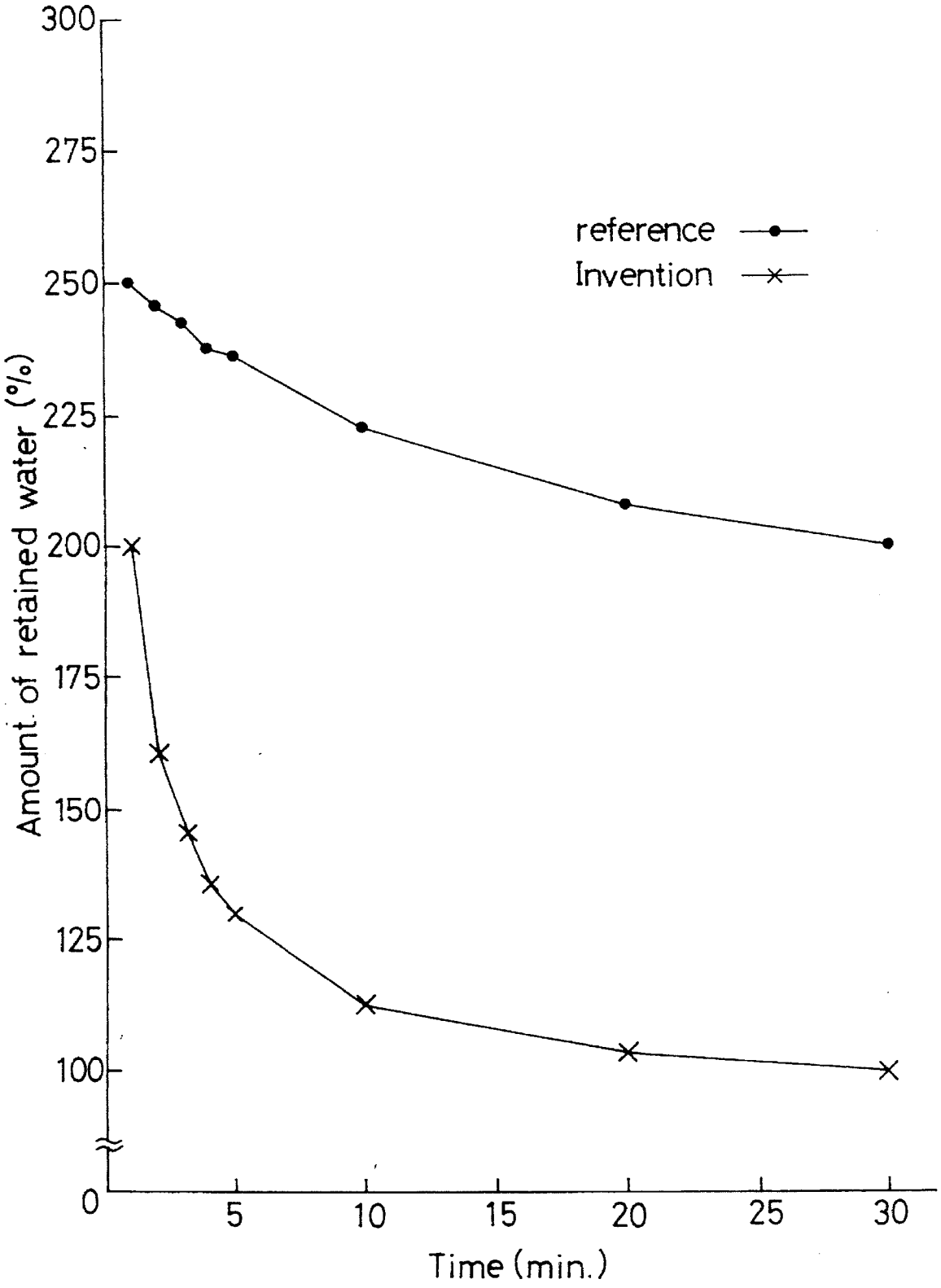
FIG. 13 is a graph showing the change in amount of retained water in the course of time.

A data of change in the amount of retained water observed in the course of time is given in FIG. 13, for the stack type evaporator in accordance with the present invention (i.e., Sample No. 1) and for the prior art popular evaporator of the one-sided header and stack type (i.e., Sample No. 2).

Evaluation of the unpleasant odor was done relying on human olfactory sense, but under a condition simulating the actual operation state of evaporator. The reference symbols "○", "Δ", "X" and "XX" respectively indicate: being odorless at the beginning of test and remaining odorless thereafter; not smelling at the beginning, but emitting odor after use for a long time; scarcely smelling at the beginning, but emitting odor before long; and, sufficiently smelling from the beginning of use.

As will be seen from the result given above, the evaporator which comprises the tubular elements each having the inwardly protruding and vertically extending recessed ribs and which has its surfaces covered with the specific hydrophilic resin coating according to the present invention, is superior to all the other reference samples of evaporator in respect of not only their odor but also of their drainaging property. Thus, both the problem of waterdrop flying and the bad smell are eliminated at the same time by the invention.

The data on water retention per unit surface area in contact with air has established a fact that the specific resin coating in the invention does match well the straight drainage canals to give the best drainage. Although the resin composition in the invention (having a contact angle of 20° or less, and 7°–13° in the embodiment) is not necessarily more hydrophilic than the water glass coating (being most hydrophilic heretofore, and having a contact angle of 5° or less), the former is less retentive of water than the latter. This indicates an "organic" and effective combination of the specific resin coating with the straight drainage canals. Furthermore, the stack type evaporator of the invention proved superior to the typical prior art one, with respect to the drainage, as shown in FIG. 13.

Figure 14:
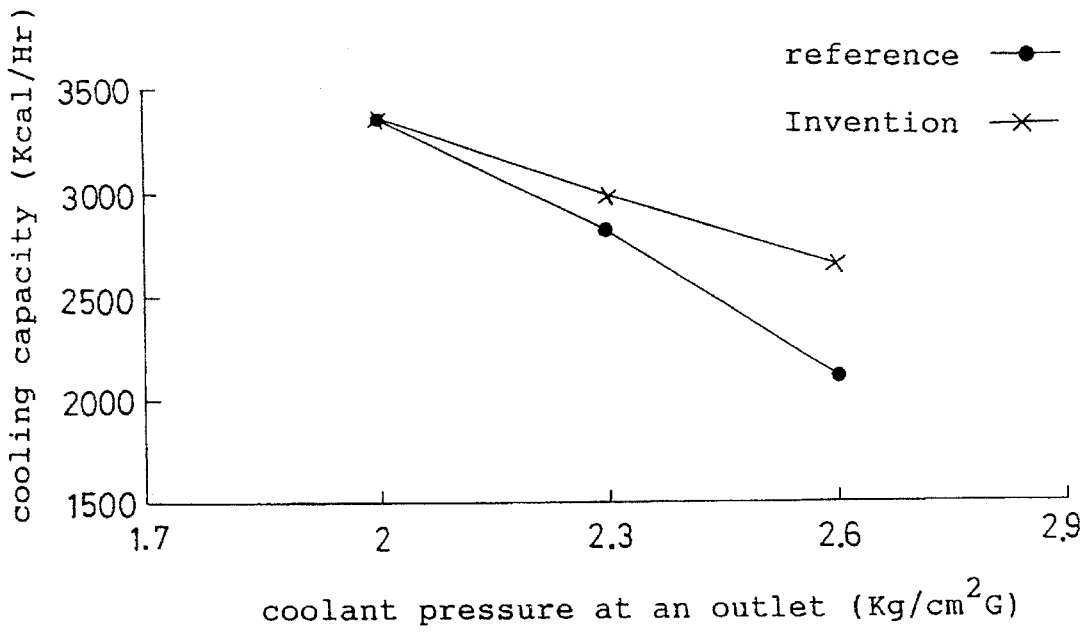
FIG. 14 is a graph showing a relationship between a cooling capacity and a coolant pressure at an outlet.
Figure 15:
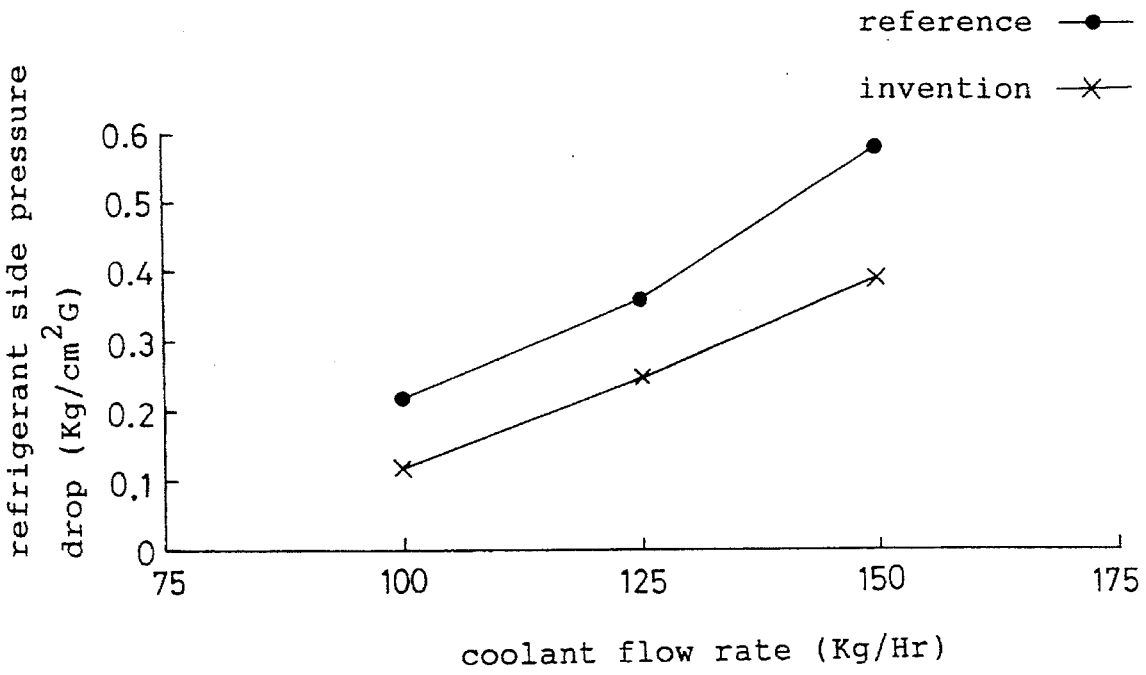
FIG. 15 is a graph showing a relationship between a coolant flow resistance and a coolant flow rate.
Figure 16:
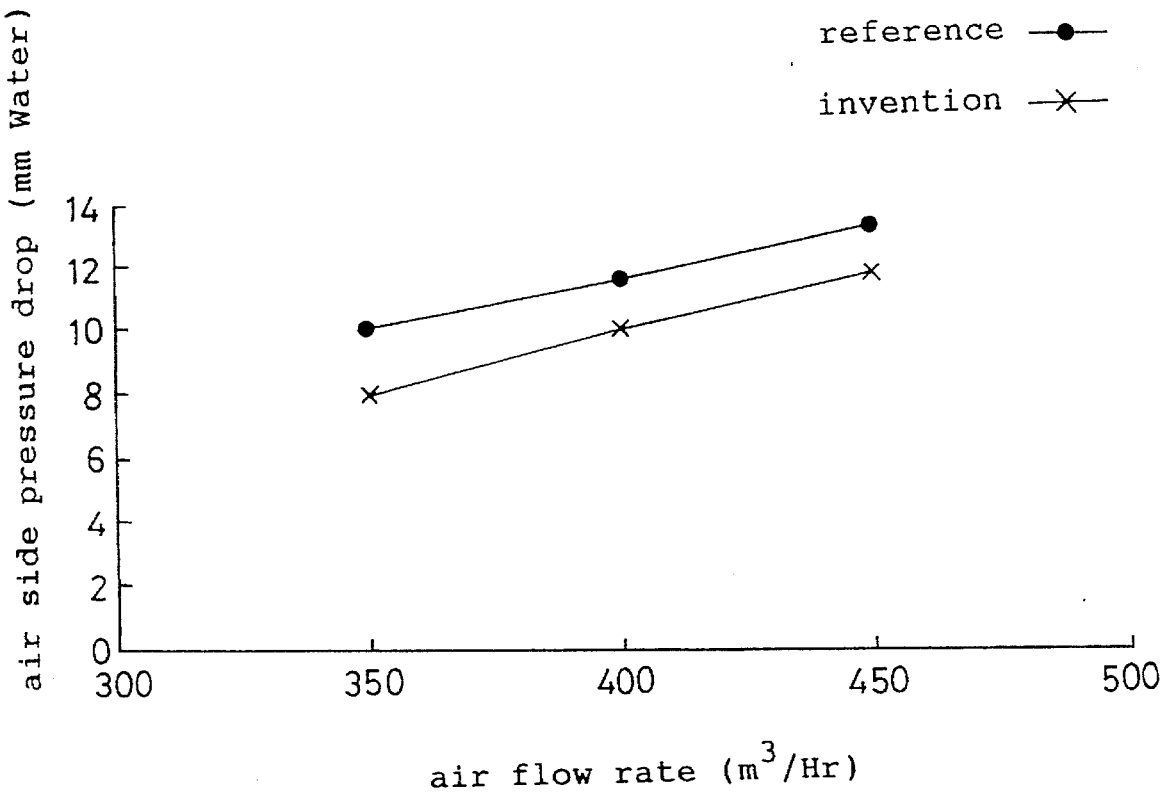
FIG. 16 is a graph showing a relationship between an air flow resistance and an air flow rate.

Further, certain performance of the sample No. 1 (invention) was compared with those of the reference No. 2 which is the stack type evaporator of the one-sided header structure and is a typical one widely and currently employed in the field. FIGS. 14 and 16 give the result of comparative tests which were executed on: their cooling capacity for varied coolant pressure at outlet; their coolant flow resistance for varied flow rate of coolant, and their air flow resistance for varied air flow rate.

The cooling capacity of the reference No. 2 decreases sharply with increasing coolant pressure at outlet, whereas the capacity of the sample No. 1 (invention) decreases gradually. This means that the evaporator provided by the invention is improved in its cooling capacity for the varied outlet coolant pressures. As for the coolant flow resistance, the sample No. 1 proved less resistive to coolant flow than the reference No. 2 by ca. 0.1 $Kg/cm^2$ or more, for varied coolant flow rates. Also, the sample No. 1 proved less resistive to air flow than No. 2 by ca. 2 mmAq, for varied air flow rates. These data indicate that the evaporator is excellent also in its cooling capacity and performance.

In summary, the evaporator in the invention comprises the tubular elements each having the inlet header portion at its one end and the outlet header portion at its other end, so that the coolant flows through the unit flow paths in the tubular element in such a manner that any offset flow or turbulent flow does not take place therein.

Consequently, heat exchange is carried out evenly and effectively throughout the evaporator, thereby improving its heat exchanging capacity as a whole and also reducing the loss in coolant pressure.

It is a more important feature that the straight drainage canals extend vertically in parallel with each other between the upper and lower header portions of each tubular element, whereby the water condensed on the surfaces of the tubular elements and fin members smoothly flows downwards along the straight canals and is quickly removed from the evaporator. A further important feature is the width and area ranges described above.

The unique combination of such straight drainage canals and ranges (i.e., two features) with the specific hydrophilic resin coating (i.e., the third feature) covering the surfaces of tubular elements and fin members produces in the invention an unexpected synergism of these features. The integrated effect is greater than the simple sum of the individual effects resulting from the features, so that the drainage or water-repelling property of the evaporator is improved in a surprising manner.

As a result, the waterdrop flying is avoided to an almost complete degree and consequently the adherent condensed water is prevented at the same time from allowing the mildew or mold to grow therein, thus keeping pleasant the air conditioned environment in the automobile interior.

The resin composition in the invention comprises polyvinyl alcohol resins as the main component as well as the hydrophilic agent (i.e., polyamide and/or polyvinyl pyrrolidone resins) blended therewith. This composition does not emit such an unpleasant odor as emitted by the water glass coating, also contributing to the better environment in the automobile interior.

In a preferable case wherein the microbicide is blended with the main component and hydrophilic agent just mentioned above, the "anti-mold" effect becomes much greater to effectively decrease the bad smell.

What is claimed is:

1. In a stack evaporator comprising:

a plurality of tubular elements each composed of a pair of facing core plates which are adjoined one to another at their peripheries so as to define a coolant path therebetween;

a plurality of fins each interposed between the two adjacent tubular elements which are stacked side by side in a direction of their thickness;

upper and lower header portions respectively formed at an upper and lower ends of each tubular element, with the header portions being connected to the other corresponding header portions so as to unite the tubular elements to form the evaporator wherein except for the header portions of the tubular elements located at predetermined positions of evaporator, the other tubular elements adjacent to each other have their header portions in fluid communication with one another through coolant flowing openings formed through summits of said header portions, wherein the walls of header portions at the predetermined positions of the first mentioned tubular elements function as partitions, which divide the tubular elements to form groups thereof, and which partitions thereby cause the coolant entering the evaporator through a coolant inlet pipe to advance in a meandering manner making turns at every boundary between the groups, before leaving the evaporator through a coolant outlet pipe; wherein the improvement comprises a plurality of straight drainage canals for condensed water, the drainage canals being formed on the outer surface of the core plates forming each tubular element so as to extend vertically in parallel with one another from the upper header portion towards the lower header portion;

a hydrophilic resin coating covering the outer surfaces of the tubular elements and the fins;

the hydrophilic resin coating being applied by immersing said outer surfaces in a solution containing a polyvinyl alcohol resin as its main component, polyamide and/or polyvinyl pyrrolidone resins as its hydrophilic agent blended with the main component, a film hardener having a concentration sufficient to produce a hardened coating but not so great as to react with hydrophilic atom groups in the hydrophilic resin molecules and thereby fail to enhance the hydrophilic property, and a surfactant to stabilize said resin solution so that it will not become bubbly; the thickness of said hydrophilic resin coating falling in a range of from about 0.2 to about 1.5 μm;

a width of each straight drainage canal covered with the hydrophilic resin coating being included in a range of from about 0.5 to about 3 mm, the width being defined as a distance between surfaces of the resin coating covering an open mouth of the canal; a depth of straight drainage canals falling within a range of from about 0.5 to about 2.5 mm, the depth being defined as a distance between a portion of the resin coating covering a flat portions and another portion of the resin coating covering a bottom of each drainage canal; and a surface area ratio falling within a range of from about 5 to about 40%, the surface area ratio being a ratio of a total area of the open mouths to an overall surface area of each core plate, and the overall surface not including expanded end regions of the core plate but inclusive of flat portions and the straight canals thereof, whereby the combination of said parallel drainage canals and said coating in said stack type evaporator results in substantially lower odor and retained water as compared to a coated scattered rib evaporator.

2. A stack type evaporator as defined in claim 1, wherein the width of each straight drainage canal is from about 1.3 mm to about 2.4 mm, and the surface area ratio is from about 15% to about 25%.

3. A stack type evaporator as defined in claim 2, wherein a depth of straight drainage canals is from about 1.5 mm to about 2.1 mm.

4. A stack type evaporator as defined in claim 1, wherein the hydrophilic resin coating further contains a microbicide.

5. A stack type evaporator as defined in claim 1, wherein the hydrophilic resin coating is composed of: from about 30 to about 65 parts by weight of polyvinyl alcohol resin as the main component; from about 20 to about 65 parts by weight of the hydrophilic agent; from about 1 to about 15 parts by weight of the film hardener; and from about 0.1 to about 2.0 parts by weight of the surfactant.

6. A stack type evaporator as defined in claim 5, wherein from about 3 to about 30 parts by weight of a microbicide is further contained in the hydrophilic resin coating.

7. A stack type evaporator as defined in claim 1, wherein the hydrophilic resin coating is composed of: from about 40 to about 60 parts by weight of polyvinyl alcohol resin as the main component; from about 35 to about 45 parts by weight of the hydrophilic agent; from about 5 to about 10 parts by weight of the film hardener; and from about 0.5 to about 1.5 parts by weight of the surfactant.

8. A stack type evaporator as defined in claim 7, wherein from about 5 to about 15 parts by weight of a microbicide is further contained in the hydrophilic resin coating.

9. A stack type evaporator as defined in claim 4, 6 or 8, wherein the microbicide is a member selected from a group consisting of: bis-(2-pyridylthio)-zinc 1,1'-diphoxide; methyl benzimidazole carbamate; and 2-(4-thiazolyl)-1H-benzimidazole.

10. A stack type evaporator as defined in claim 1, wherein the thickness of the hydrophilic resin coating is from about 0.5 to about 1.3 μm.

11. A stack type evaporator as defined in claim 1 wherein the film hardener is a member selected from a group consisting of a phenolic resin and a polyurea resin.

12. A stack type evaporator as defined in claim 1 wherein the surfactant is a nonionic surface active agent.

* * * * *